US011278066B2

(12) United States Patent
Briggs

(10) Patent No.: US 11,278,066 B2
(45) **Date of Patent: *Mar. 22, 2022**

(54) PROTECTIVE BELT APPARATUS

(71) Applicant: Aubrey C. Briggs, Sewickley Heights, PA (US)

(72) Inventor: Aubrey C. Briggs, Sewickley Heights, PA (US)

(73) Assignee: Leonard C. Briggs, Sewickley Heights, PA (US)

( * ) Notice: Subject to any disclaimer, the term of this patent is extended or adjusted under 35 U.S.C. 154(b) by 1244 days.

This patent is subject to a terminal disclaimer.

(21) Appl. No.: 15/355,192

(22) Filed: Nov. 18, 2016

(65) Prior Publication Data

US 2017/0079340 A1 Mar. 23, 2017

Related U.S. Application Data

(63) Continuation of application No. 13/860,640, filed on Apr. 11, 2013, now Pat. No. 9,532,611.

(Continued)

(51) Int. Cl.

| | |
|---|---|
| ***A41D 13/018*** | (2006.01) |
| ***A41D 13/05*** | (2006.01) |
| ***A41F 9/00*** | (2006.01) |
| ***A41D 13/015*** | (2006.01) |
| ***A41D 13/00*** | (2006.01) |

(Continued)

(52) U.S. Cl.

CPC ..... *A41D 13/018* (2013.01); *A41D 1/002* (2013.01); *A41D 13/00* (2013.01); *A41D 13/0155* (2013.01); *A41D 13/0506* (2013.01); *A41D 13/0525* (2013.01); *A41D 13/0531* (2013.01); *A41D 13/06* (2013.01); *A41D 13/065* (2013.01); *A41F 9/002* (2013.01)

(58) Field of Classification Search

CPC ..... A41D 13/012; A41D 13/0125; A41D 13/0155; A41D 13/018; A41D 13/065; A41D 13/0506; A41D 13/0525; A41D 13/0531; A41D 13/0537; A41D 13/0543

USPC ..... 2/DIG. 3

See application file for complete search history.

(56) References Cited

U.S. PATENT DOCUMENTS 1,080,985 A * 12/1913 Leap ..... A41F 9/002 2/267

3,271,782 A * 9/1966 Mallett ..... A41F 9/007 2/236

(Continued)

*Primary Examiner* — Sally Haden

(74) *Attorney, Agent, or Firm* — Eckert Seamans Cherin & Mellott, LLC

(57) ABSTRACT

A belt apparatus is configured to support the trousers worn by a person and to include a number of airbags that are deployable in a falling event to protect the person from bone breakages. The belt apparatus includes a flexible belt element and a fastener that appear and function in much the same way as an ordinary trouser belt, i.e., fitting through belt loops in trousers and being fastenable to itself to support the pair of trousers at the waist of the user. Despite the ordinary appearance of the belt apparatus, it includes one or more airbags internal thereto whose expansion is controlled by a control apparatus. Responsive to a falling event in a particular direction with respect to the user, the control apparatus triggers the rapid expansion of an airbag that is situated on the belt element in the particular direction with respect to the user.

16 Claims, 7 Drawing Sheets

Related U.S. Application Data

(60) Provisional application No. 61/679,135, filed on Aug. 3, 2012.

(51) Int. Cl.
*A41D 13/06* (2006.01)
*A41D 1/00* (2018.01)

(56) References Cited

U.S. PATENT DOCUMENTS 3,789,431 A * 2/1974 Rand ..... A41F 9/007 2/236
5,362,098 A * 11/1994 Guill ..... A41D 13/018 2/456
5,500,952 A * 3/1996 Keyes ..... A41D 13/018 2/465
5,937,443 A * 8/1999 Kageyama ..... A41D 13/018 2/455
7,017,195 B2 3/2006 Buckman et al.
7,150,048 B2 12/2006 Buckman
9,107,615 B2 8/2015 Buckman
10,154,695 B2 * 12/2018 Jin ..... A61B 5/1117
2006/0288464 A1 * 12/2006 Warden ..... A41D 13/018 2/69
2009/0254003 A1 * 10/2009 Buckman ..... A61B 5/1117 600/595
2012/0090076 A1 * 4/2012 Kenney ..... A41D 13/0017 2/212
2013/0312168 A1 * 11/2013 Raanan ..... A41D 13/0506 2/465
2014/0033413 A1 * 2/2014 Briggs ..... A41D 13/00 2/466
2014/0047623 A1 * 2/2014 Richards ..... A41D 13/018 2/455
2014/0123374 A1 * 5/2014 Gelston ..... A41D 13/018 2/455
2014/0230135 A1 * 8/2014 Fenyves ..... A41D 13/018 2/455
2015/0101112 A1 * 4/2015 Balbien ..... A41D 13/018 2/465
2015/0238124 A1 8/2015 Buckman
2015/0272248 A1 * 10/2015 Briggs ..... A41F 9/002 2/465
2015/0351666 A1 12/2015 Buckman
2017/0181485 A1 * 6/2017 Jin ..... A61B 5/1117
2017/0208874 A1 * 7/2017 Davenport ..... A41D 13/018
2017/0224031 A1 * 8/2017 Raanan ..... A41D 13/018
2017/0281056 A1 * 10/2017 Raanan ..... A61B 5/1117
2019/0069612 A1 * 3/2019 Hyde ..... A41D 13/018

* cited by examiner

PROTECTIVE BELT APPARATUS

CROSS REFERENCE TO RELATED APPLICATION

The instant application claims priority from U.S. Provisional Patent Application Ser. No. 61/679,135 filed Aug. 3, 2012, and entitled Belt With Airbags, and U.S. patent application Ser. No. 13/860,640 filed Apr. 11, 2013, and entitled Protective Belt Apparatus, the disclosures of which are incorporated herein by reference.

BACKGROUND

Field

The disclosed and claimed concept relates generally to structures that are intended to protect a person from injury and, more particularly, to a belt apparatus that is structured to resist the breakage of bones as a result of a falling event.

Related Art

A person's bones are understood to gradually become more brittle and thus more subject to breakage as the person ages. It is also understood that a person's muscular tone and strength likewise decreases with age. The loss of muscular tone and strength can, along with other factors, can have a tendency to reduce balance and coordination in an older person, which can contribute to the potential that the person might experience a falling event, i.e., an event wherein the person falls onto a floor, against a wall, or against another object. The reduced muscular tone and strength also reduces the person's ability to catch himself or herself or to otherwise protect himself or herself during a falling event. Furthermore, the aforementioned brittleness of the bones in an aged person increases the likelihood that one or more bones might be broken as a result of a falling event.

It can therefore be said that, as a general matter, aged persons are relatively more likely to experience falling events, and such falling events are likely to involve a relatively greater impact because of the person's inability to catch himself or herself, with the result that an aged person is generally at a greater risk of the breakage of bones than a younger person. It is also generally understood that a significant skeletal break can be sufficiently detrimental to a health of an aged person that the aged person may die as a direct result of the breakage. At the very least, a significant bone breakage in an older person is detrimental to the person's health due to factors such as the increased potential for infection and the physical resources required to heal the bone break, and also due to the pain and suffering experienced by the person, as well as other factors.

It thus would be desirable to provide a solution that can help people, particularly aged people, to avoid bone breakages that would otherwise be significantly detrimental to the person's health.

SUMMARY

An improved belt apparatus that meets these needs and other needs is configured to support the trousers worn by a person and to include a number of airbags that are deployable in a falling event to protect the person from bone breakages. The belt apparatus includes a flexible belt element and a fastener that appear and function in much the same way as an ordinary trouser belt, i.e., fitting through belt loops in trousers and being fastenable to itself to support the pair of trousers at the waist of the user. Despite the ordinary appearance of the belt apparatus, it includes one or more airbags internal thereto whose expansion is controlled by a control apparatus. Responsive to a falling event in a particular direction with respect to the user, the control apparatus triggers the rapid expansion of an airbag that is situated on the belt element in the particular direction with respect to the user. The expansion is delayed or timed with respect to the initial detection of the falling event to cause the rapid expansion of the airbag to generally coincide with a time just prior to an impact in order to protect those bones of the user that otherwise might have injuriously impacted a floor, a wall, or other structure.

Accordingly, an aspect of the disclosed and claimed concept is to provide a belt apparatus that appears and functions in exactly the same way as a conventional apparel belt or trouser belt, but that additionally protects the user from injury in a falling event.

Another aspect of the disclosed and claimed concept is to provide an improved belt apparatus that is worn by a user in substantially exactly the same fashion that the user would wear a conventional trouser belt.

Another aspect of the disclosed and claimed concept is to provide an improved belt apparatus having a plurality of airbags, which detects a falling event in a particular direction with respect to the user, and which responsively triggers the expansion of an airbag that is situated generally in the particular direction with respect to the user and which thus protects the user and resists the breakage of bones in the particular direction with respect to the user.

Another aspect of the disclosed and claimed concept is to provide an improved belt apparatus which, during a falling event in a particular direction with respect to the user, deploys certain airbags situated generally in the particular direction with respect to the user without necessarily deploying all of the airbags of the belt apparatus.

These and other aspects are provided by an improved belt apparatus that is structured to support a pair of trousers having a number of belt loops. The belt apparatus can be generally stated as including a trouser support apparatus, a protection apparatus, a control apparatus, and an expansion apparatus. The trouser support apparatus has an elongated and flexible belt element having a number of cavities formed therein and being structured to extend through at least some of the number of belt loops of the pair of trousers and to assist in supporting at least a portion of the pair of trousers at the waist of a user. The trouser support apparatus further can be stated as including a fastener structured to be cooperable with the belt element to retain the belt element at a selected circumferential length. The protection apparatus can be generally stated as including a number of cushion elements that are each structured to be movable from a collapsed configuration situated within a cavity of the number of cavities to an expanded configuration situated at least partially outside the cavity and in protective proximity to a body part of the user. The control apparatus can be generally stated as including a number of fall-detection elements and being structured to output a trigger signal responsive to a falling event of the user. Responsive to the trigger signal, the expansion apparatus is structured to expand at least a first cushion element of the number of cushion elements from the collapsed configuration to the expanded configuration.

BRIEF DESCRIPTION OF THE DRAWINGS

A further understanding of the disclosed and claimed concept can be gained from the following Description when read in conjunction with the accompany drawings in which:

Similar numerals refer to similar parts throughout the specification.

DESCRIPTION

Figure 1:
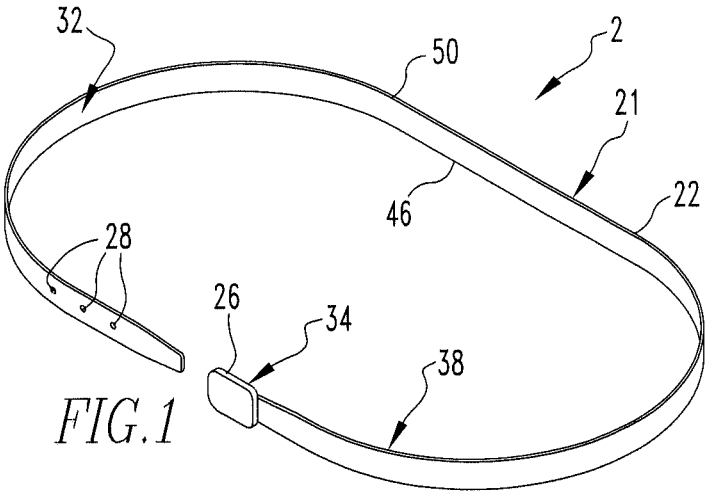
FIG. 1 is a schematic view of an improved belt apparatus in accordance with a first embodiment of the disclosed and claimed concept.
Figure 2:
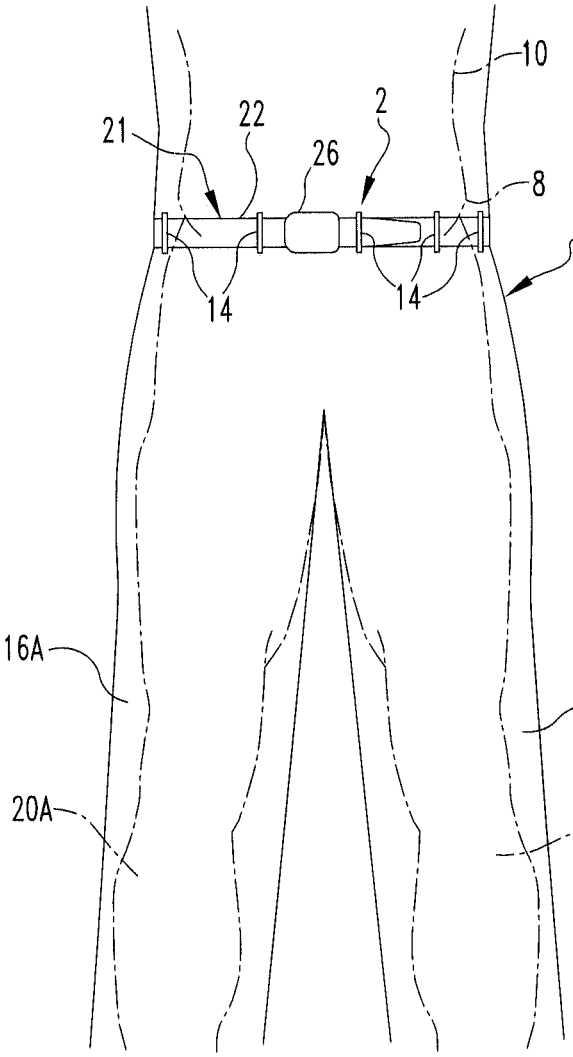
FIG. 2 is a schematic depiction of the belt apparatus of FIG. 1 during ordinary use supporting a pair of trousers at generally the waist of a user.

An improved belt apparatus 2 in accordance with the disclosed and claimed concept is depicted generally in FIGS. 1-3, 7, and 8. The belt apparatus 2 has the appearance and function of a conventional apparel belt or trouser belt but, as will be set forth in greater detail below, is advantageously configured to protect a person from injury as a result of a falling event.

The belt apparatus 2 is configured to support a pair of trousers 4 at approximately the waist 8 of a user 10. The trousers 4 can be conventional items of apparel and can be of any length. The exemplary depicted trousers 4 include a plurality of belt loops 14 and a pair of pant legs 16A and 16B that are intended to clothe a pair of legs 20A and 20B of the user 10. In a conventional fashion, the belt apparatus 2 is received in the belt loops 14 and is fastenable with itself at a selected circumferential length to retain the trousers 4 at the waist 8 of the user 10.

Figure 3:
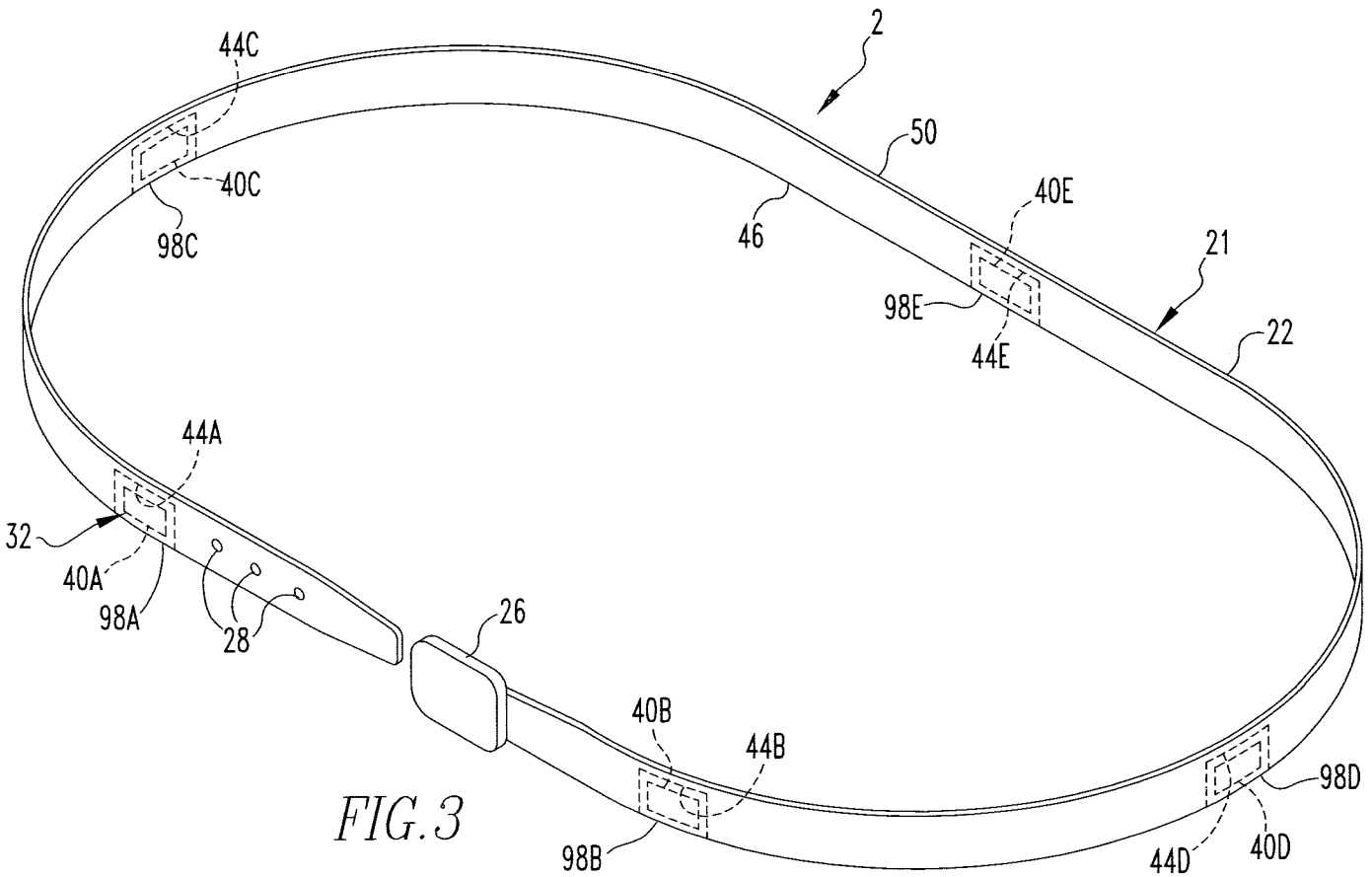
FIG. 3 is another view of the belt apparatus of FIG. 1.

As can be understood from FIGS. 1 and 3, the belt apparatus 2 includes trouser support apparatus 21 that can be said to include an elongated and flexible belt element 22 and a fastener. The fastener is situated at one of the belt element 22 and is in the exemplary form of a buckle 26. The belt element 22 can be formed of any of a wide variety of materials such as leather, canvas, or webbing material, such as in the fashion of a conventional trousers belt and which, in the depicted exemplary embodiment, has a number of holes 28 formed therein in the vicinity of an end of the belt element 22 that is opposite the end where the buckle 26 is situated. As employed herein, the expression "a number of" and variations thereof shall refer generally to any non-zero quantity, including a quantity of one. The exemplary buckle 26 is one having a fixed pin (not expressly shown herein) protruding therefrom that is receivable in one of the holes 28 to retain the belt apparatus 2 and particularly the belt element 22 at a selected circumferential length. It is noted, however, that the belt element 22 and the buckle 26 can be in any of a variety of configurations and can interact with one another in the fashion of any of variety of known conventional trouser belts that are used as apparel without limitation. The belt apparatus 2 is advantageously configured to be usable by the user 10 in essentially exactly the same way as a conventional trouser belt, with the result that the user 10 can be protected from bone breakage in a falling event without having to make any special efforts or take any special actions other than installing the belt apparatus 2 on the trousers 4 in virtually the same way that the user 10 would employ a conventional belt to support the trousers 4.

The belt apparatus 2 additionally includes a protection apparatus 32, a control apparatus 34, and an expansion apparatus 38 that are situated on the trouser support apparatus 21 and that are cooperable to protect the user from injury as a result of a falling event. That is, such apparatuses are cooperable such that, during a falling event, skeletal injuries are advantageously reduced or avoided completely.

Figure 8:
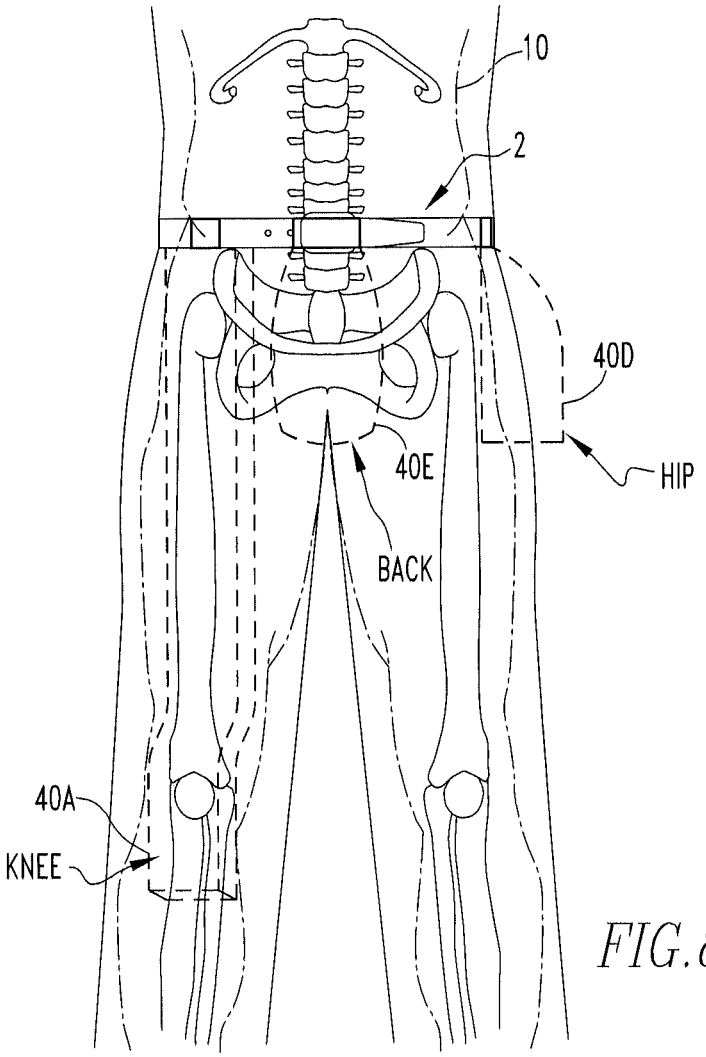
FIG. 8 is a view similar to FIG. 7, except depicting a front elevational view of the belt apparatus and further depicting in dashes lines some of the airbags of the belt apparatus in an expanded configuration.

The protection apparatus 32 includes a plurality of cushion elements 40A, 40B, 40C, 40D, and 40E (collectively referred to herein with the numeral 40) which, in the depicted exemplary embodiment, are embedded within the belt element 22, as is shown in FIG. 3, and are individually expandable by the expansion apparatus 38 under the direction of the control apparatus 34. The cushion elements 40 are depicted in FIG. 3 as being in a collapsed configuration wherein they are each situated substantially entirely within the belt element 22. The cushion elements 40 are generally in the exemplary form of airbags that are expandable by the expansion apparatus 38 from the collapsed configuration depicted generally in FIG. 3 to an expanded condition protruding to the exterior of the belt element 22 and being shaped as is indicated generally in FIG. 8. That is, FIG. 8 generally depicts in dashed lines the cushion elements 40A, 40D, and 40E as each being in their expanded configuration, although in use, as will become apparent, the belt apparatus 2 is unlikely to simultaneously deploy the cushion elements 40A, 40D, and 40E. It is thus understood that FIG. 8 is intended primarily to illustrate the positioning and shapes of the various cushion elements 40 in their expanded configurations.

Figure 4A:
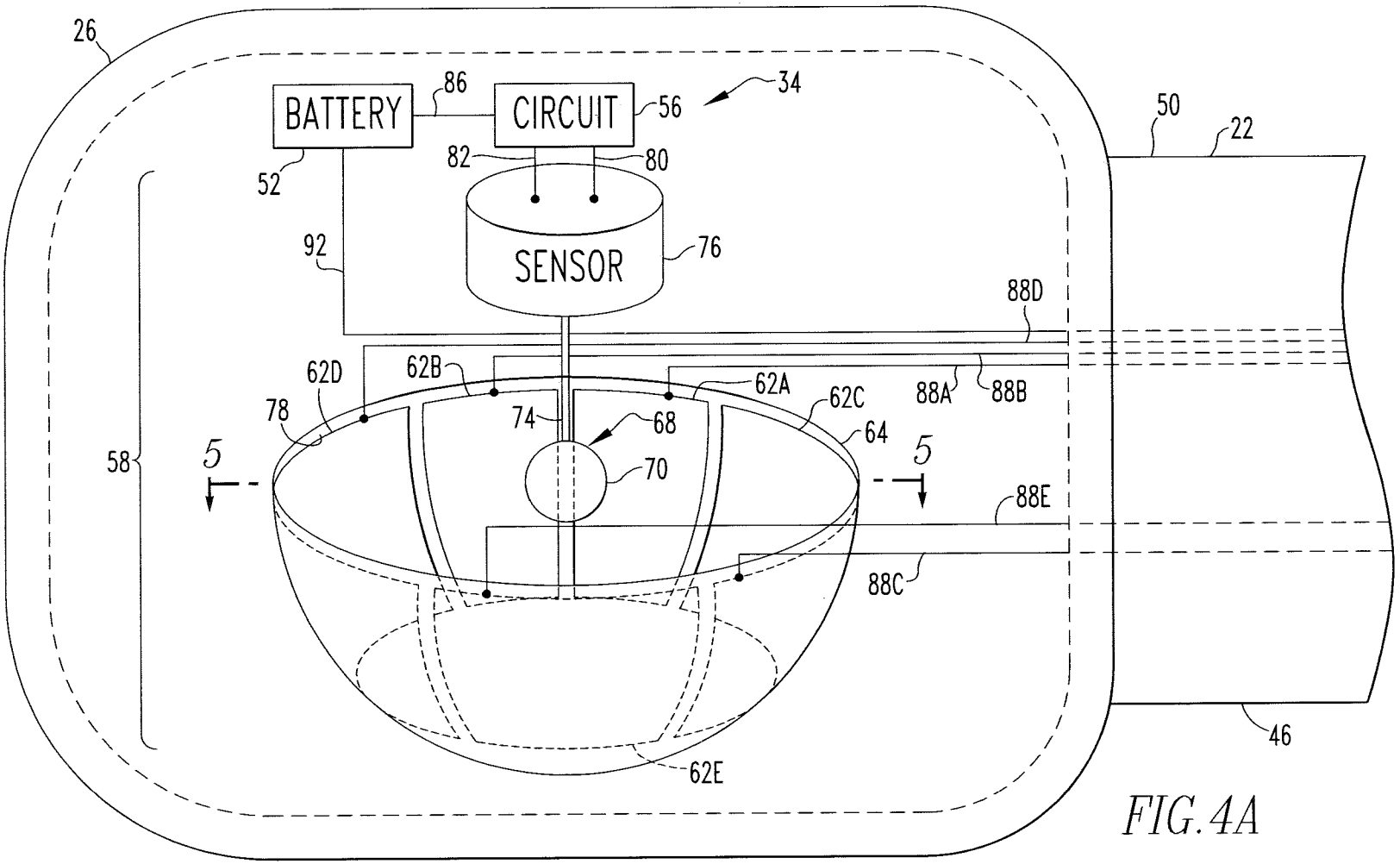
FIG. 4A is a view, partially cut away, of the improved belt apparatus of FIG. 1.
Figure 4B:
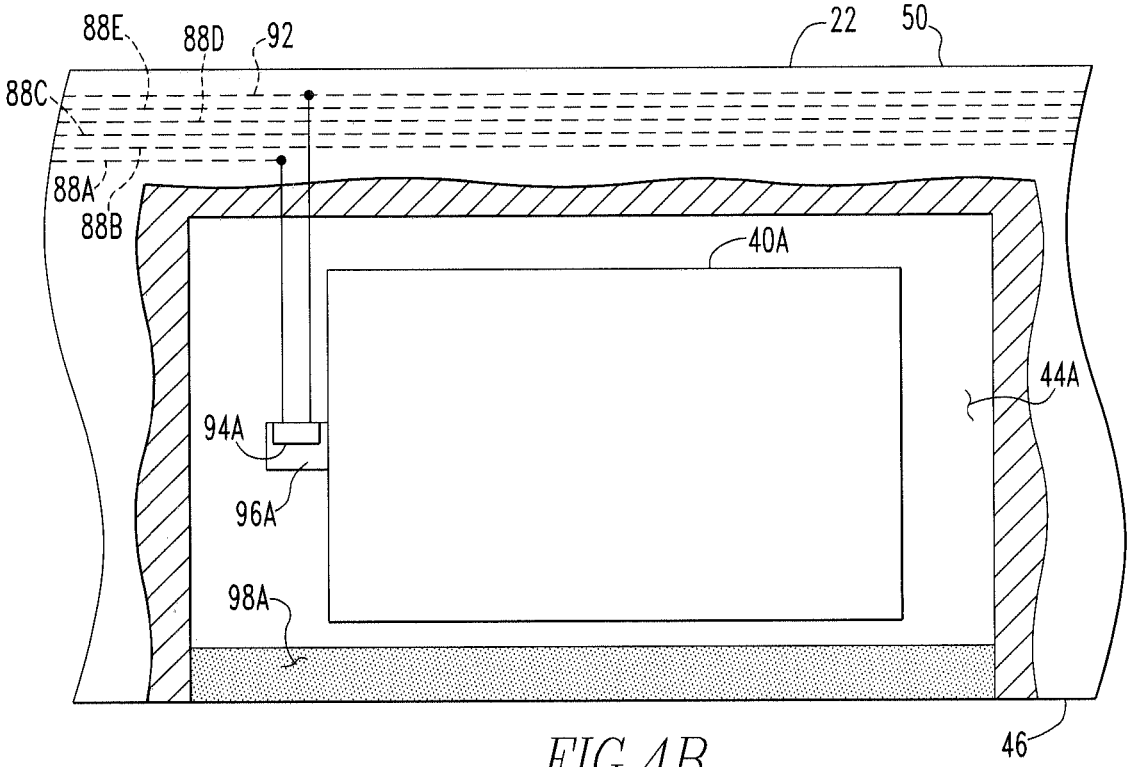
FIG. 4B is a schematic view, partially cutaway, of another portion of the belt apparatus of FIG. 1

As can be understood from FIGS. 3 and 4B, the belt element 22 has a plurality of cavities 44A, 44B, 44C, 44D, and 44E (collectively referred to herein with the numeral 44) formed therein within which the cushion elements 40 are disposed. The belt apparatus 2 can be further said to have an elongated first edge and an elongated second edge 50 opposite one another on the belt element 22. In use, and as can be understood generally from FIG. 8, the first edge 46 is a lower edge of the belt element 22, and the second edge 50 is an upper edge of the belt element 22, both being from the perspective of FIG. 8. The belt element 22 has a length that is significantly greater than its width, i.e., the distance between the first and second edges 46 and 50, and the width is likewise significantly greater than the thickness of the belt element 22 as is depicted generally in FIG. 4C. The cavities 44 are configured such that they retain the cushion elements 40 situated therein in the collapsed configuration without the cushion elements 40 meaningfully affecting the flexibility of the belt element 22, whereby the belt element 22 and the buckle 26 appear to the user 10 and are usable thereby in substantially exactly the same fashion as an ordinary apparel belt of the type that is generally known for retaining trousers at the waist of a user.

In the depicted exemplary embodiment, the control apparatus 34 is situated generally on the buckle 26, and the expansion apparatus 38 is situated generally on the belt element 22. It is understood, however, that different arrangements of the elements described herein can be employed without departing from the present concept.

As can be understood generally from FIG. 4A, the control apparatus 34 can be said to include a power source 52 which in the exemplary embodiment depicted herein is in the form of a small battery of conventional chemistry. The control apparatus 34 further includes a control circuit 56 and a plurality of fall-detection elements 58 that are cooperable with the control circuit 56. The exemplary fall-detection elements 58 include a plurality of contacts 62A, 62B, 62C, 62D, and 62E (collectively referred to herein with the numeral 62) that are situated on a support 64 and further include a pendulum 68 having a mass 70 that is situated at a free end of a flexible support element 74. The number of fall-detection elements 58 can further be said to include a sensor 76 that is connected with the control circuit 56.

The support 64 is generally of a hollow semi-spherical shape having an inner surface 78 that is likewise of a semi-spherical shape. It the contacts 62 are thus each of a partially spherical shape. The contacts 62 are each electronically connected with elements of the expansion apparatus 32 and are operatively connected with the cushion elements 40 to enable them to move from their collapsed configuration to their expanded configuration, as will be set forth in greater detail below.

The mass 70 of the pendulum 68 is a conductive element, i.e. conductive on at least its exterior surface, and is movable about the interior region of the support 64 (which is generally bounded by the contacts 62) while being suspended from the support element 74. In the depicted exemplary embodiment, the support element 74 is likewise electrically conductive and is electrically connected with the mass 70 and is further electrically connected with the control circuit 56 via a lead 80. The sensor 76 is electronically connected with the control circuit 56 via another lead 82, and the power source 52 is electrically connected with the control circuit 56 via a further lead 86. Each contact 62A, 62B, 62C, 62D, and 62E is electrically connected with one of a plurality of leads 88A, 88B, 88C, 88D, and 88E (collectively referred to herein with the numeral 88), respectively. An additional lead 92 is connected with the ground terminal of the power source 52.

The sensor 76 is structured to detect a velocity and/or an acceleration of the mass 70 and/or the support element 74, and such velocity and acceleration can be linear or angular or both. In one exemplary embodiment, the sensor 76 detects the angular velocity of the support element 74 with respect to the sensor 76, and such angular velocity can be referred to with the designation $d\theta/dt$. The sensor 76 can be any of a variety of sensing devices such as accelerometers, optical sensors, eddy current sensors, and the like without limitation. Moreover, the sensor 76 can detect the aforementioned velocity and/or acceleration, linear and/or angular, in any of a variety of fashions. In this regard, and by way of example, it is understood that the sensor 76 might detect the position of the support element 74 or the position of the mass 70 or both as a function of time and from which velocities and accelerations, both linear and angular, can be derived. It thus can be said that the sensor 76 outputs to the control circuit 56 a movement signal that is representative of a velocity or an acceleration or both of the mass 70 and/or the support element 74, it being understood that the actual determination of the velocity and/or acceleration might be calculated by the control circuit 56 itself rather than by the sensor 76.

During ordinary use of the belt apparatus 2, meaning during wearing of the belt apparatus 2 by the user 10, the mass 70 remains suspended on the support element 74 and freely moves about within the interior of the support 64 and potentially comes into electrical engagement with one or more of the contacts 62. Such electrical engagement between the mass 70 and one or more of the contacts 62 does not necessarily cause any other actions to occur on the belt apparatus 2. This is because the control circuit 56 is advantageously configured to ignore daily occurrences that are not falling events. For example, a person may move from a standing position to a sitting position, and the $d\theta/dt$ of such an event is less than that which would indicate a falling event. The control circuit 56 effectively ignores such events as being indicative of false alarms, i.e., occurrences that appear to share some characteristics with a fall but that are not falling events. Other types of occurrences that are ignored as false alarms would include riding on an amusement park ride such as a roller coaster, driving in an automobile over a bumpy road, shooting a firearm, etc. In this regard, the control circuit 56 may employ logic that includes representations of a number of predetermined events, such as those set forth in the preceding sentence, which are automatically ignored as false alarms.

However, if the signal from the sensor 76 is interpreted by the control circuit 56 to be indicative of an initiation of a falling event, the control circuit 56 generates a triggering signal which is communicated to the mass 70 through the lead 80 and the support element 74. When the mass 70 electrically engages one of the contacts 62, the triggering signal is communicated through the engaged contact 62 and is further communicated therefrom as a directional triggering signal along the lead 88 that is connected with the engaged contact 62.

Figure 6:
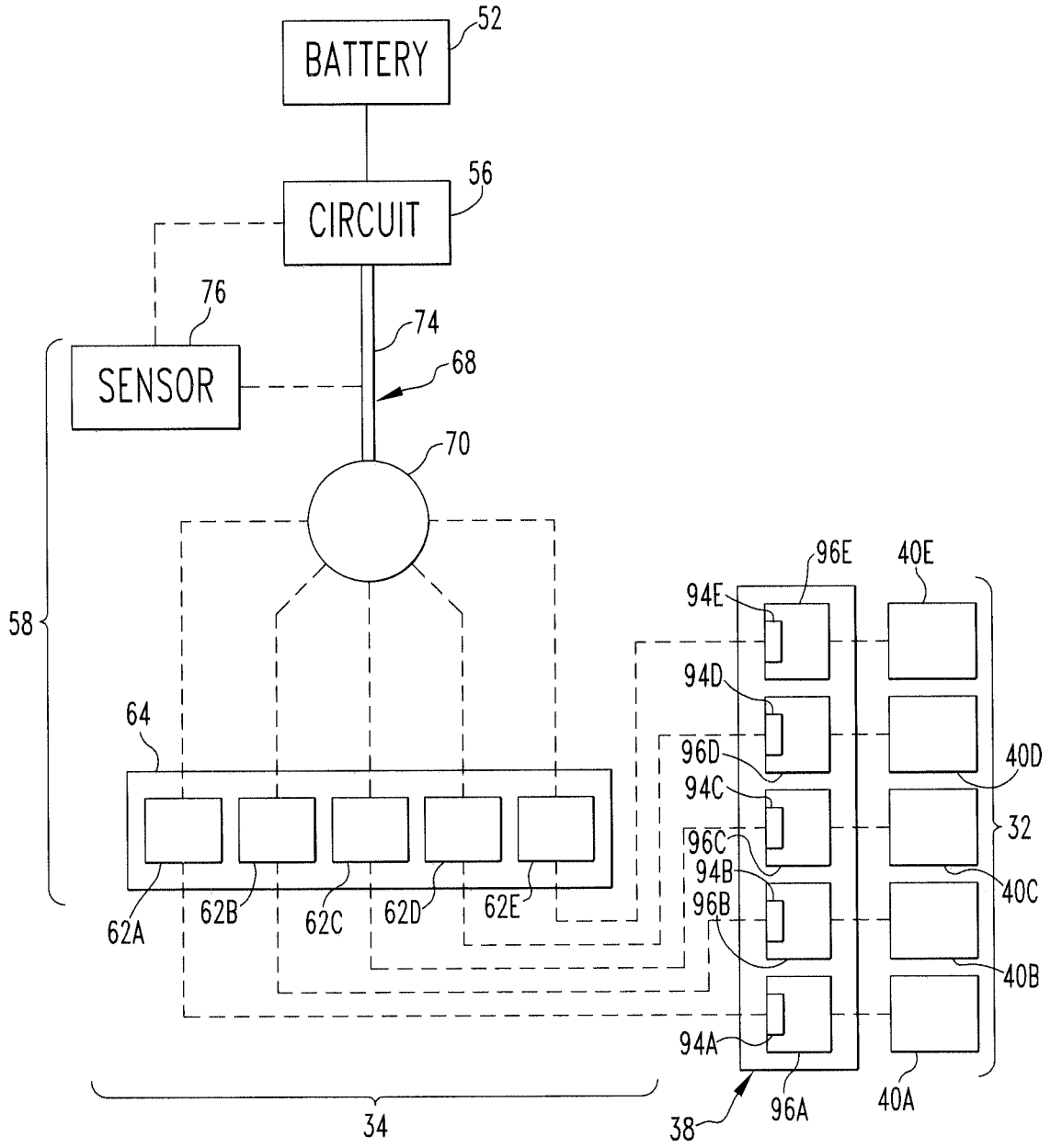
FIG. 6 is a schematic depiction of portions of a control apparatus of the belt apparatus of FIG. 1.

As can be understood from FIG. 6, the expansion apparatus 38 includes a plurality of igniters 94A, 94B, 94C, 94D, and 94E (collectively referred to herein with the numeral 94) that are configured to ignite separate amounts of propellant 96A, 96B, 96C, 96D, and 96E (collectively referred to herein at the numeral 96). The exemplary propellant 96 employed herein is sodium azide ($NaN_3$) which, when ignited by one of the igniters 94, rapidly generates a large volume of nitrogen gas ($N_2$) that is used to move a corresponding cushion element 40 from its collapsed configuration to its expanded configuration, such as in the fashion of an automobile airbag. When the directional triggering signal is communicated along one of the leads 88 to a corresponding igniter 94, it ignites the associated charge of propellant 96.

Figure 4C:
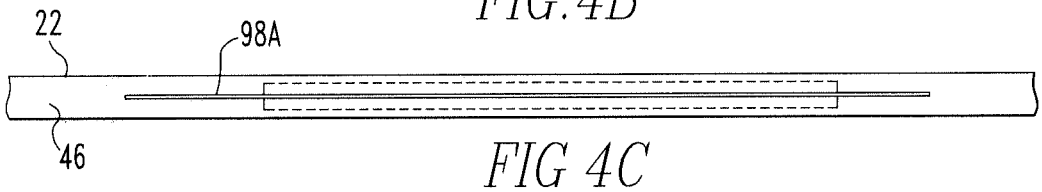
FIG. 4C is a view from another perspective of the portion of the belt depicted generally in FIG. 4B.

The cushion elements 40 are each in the form of generally enclosed bags that either have the propellant 96 situated therein or that have an opening through which the nitrogen gas generated by the propellant 96 can be introduced into the interior of the cushion element 40. As such, the nitrogen gas that is rapidly generated by the propellant 96 expands the corresponding cushion element 40 from the collapsed configuration to the expanded configuration with explosive force. The belt element 22 thus is formed to include a plurality of frangible regions 98A, 98B, 98C, 98D, and 98E (indicated schematically in FIG. 3 and collectively referred to herein with the numeral 98) that are situated generally at the first edge 46 and extend at least slightly into the interior of the belt element 22, as can be seen more particularly with the frangible region 98A in FIG. 4B. The frangible regions 98 are generally closed when the cushion elements 40 are in their collapsed configuration, as can be seen in FIG. 4C, and such frangible regions 98 can be retained in such a closed condition through the use of adhesives, fastening structures, or in any of a wide variety of understood fashions. Upon ignition of the charge of propellant 96 associated with any cushion element 40, the nitrogen gas that is generated by the propellant 96 expands the associated cushion element 40 with explosive force which causes the associated frangible region 98 to break or otherwise separate, which thereby permits the cushion element 40 to protrude out of the frangible region 98 to the exterior of the belt element 22 in protective proximity with a portion of the body of the user 10. It thus can be understood that the control apparatus 34 is configured to detect that a falling event is occurring in a particular direction with respect to the user 10 and is further configured to generate a directional trigger signal which causes the expansion apparatus 38 to deploy at least one cushion element 40 that is situated in the particular direction with respect to the user 10. This desirably interposes the deployed cushion element 40 between a body part of the user 10 and another object such as a floor, a wall, or another object.

The cushion elements 40 are desirably rapidly expanded, i.e., inflated by the nitrogen gas from the ignited propellant 96, but are also desirably deflated promptly thereafter in order to avoid the user 10 rebounding from the expanded cushion element 40. That is, the expanded cushion element 40 advantageously absorbs some of the energy of the fall, thereby allowing the user 10 to contact the floor, the wall, etc. with far less energy than would occur in the absence of the belt apparatus 2. The fall is desirably of sufficiently low energy that the breakage of bones is avoided. The deflation of the cushion element 40 is thus intended to dissipate the absorbed energy to thereby avoid the cushion element acting like a spring and redirecting any energy that has been absorbed back into the user 10, which might cause the user to fall in another direction with the same energy or which might itself cause a bone breakage if such energy is not dissipated. The cushion elements 40 are thus advantageously formed of 6-6 nylon that is woven in a fashion that it is reactive to the explosive expansion of the gases generated by the propellant 96 but that have sufficient spacing among the fibers thereof to permit the gas to escape through the interstices of the fabric of the cushion element 40, such as in the fashion of an automobile airbag.

Figure 7:
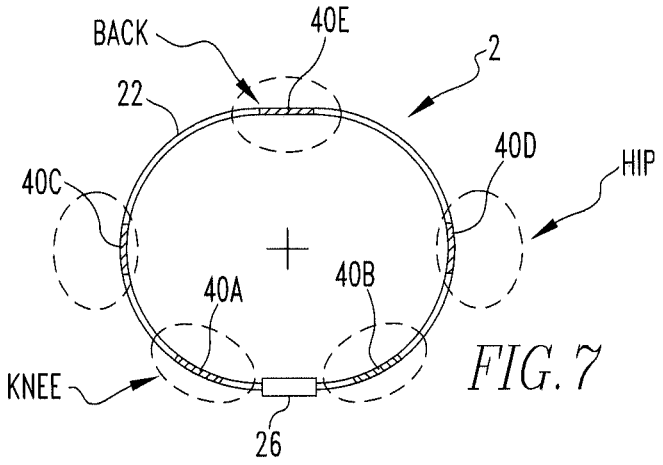
FIG. 7 is a schematic top plan view of the belt apparatus of FIG. 1 as it would be situated on the user, as in FIG. 2.

The positioning and configuration of the various cushion elements 40 is depicted generally in FIGS. 7 and 8. The cushion element 40A is intended to protect the right knee of the user and is depicted in an expanded configuration in FIG. 8A. The cushion element 40B is a mirror image of the cushion element 40A and is intended to protect the left knee of a user. When the belt apparatus 2 is worn by the user 10, the cushion elements 40A and 40B are situated generally anterior to the user 10. As can be understood generally from FIG. 8, the cushion elements 40A and 40B can each be said to include a first elongated region which, when expanded, is intended to extend from the belt apparatus 2 and along the femur toward the knee. The cushion elements 40A and 40B each further have a second elongated region distal to the first elongated region that is offset from the first elongated region and is intended to be in protective proximity of the knee.

The cushion elements 40C and 40D are relatively wider than the cushion elements 40A and 40B and are intended to protect the right and left hips, respectively, of the user 10. The cushion element 40D is depicted generally in FIG. 8 in its expanded configuration. The cushion element 40C in its expanded configuration is a mirror image of cushion element 40D. In use, the cushion elements 40C and 40D are situated generally laterally with respect to the user 10. The relatively shorter but wider configuration of the cushion elements 40C and 40D when compared with the cushion elements 40A and 40B enables the cushion elements 40C and 40D to protect, for instance, the right and left pelvic arches, respectively, during a falling event.

The cushion element 40E is generally rectangular in shape and is intended to protect the pelvis and lower spine, as is indicated in FIG. 8. The cushion element 40E is thus situated at the posterior of the user 10 when the belt apparatus 2 is worn by the user 10.

While the cushion elements 40 are described herein as each being extendable (in the expanded configuration) through a corresponding frangible region 98 situated at the first edge 46, it is understood that the cushion elements 40 can extend through other types of frangible regions or may be otherwise retained on the belt element 22 while still providing the protective proximity to the various body parts described above. Moreover, the exemplary depicted cushion elements 40 or other types of cushion elements that are intended to protect other parts of the body can extend from other portions of the belt element 22. For example, an additional cushion element might be configured to expand in a direction opposite the direction of expansion of the cushion element 40E and may be configured to protect the lumbar and thoracic spine of the user 10, by way of example. Other types of cushion elements can be envisioned.

As set forth above, the cushion elements 40 are each configured to be inflated rapidly. Upon ignition of the propellant 96, the gases generated thereby can cause the related cushion elements 40 to expand nearly instantaneously. Since the cushion elements 40 also desirably deflate promptly after expansion, the ignition of the propellant 96 is desirably timed to coincide with roughly the time at which the user 10 is about the strike the ground or another object subsequent to the onset of the falling event. That is, acceleration due to gravity is a well understood concept, and is understood that the knees, hips, and pelvis of a user in the midst of a falling event typically fall toward the ground at velocities slower than would be experienced purely due to gravity since the knees, hips, and pelvis of the user 10 most typically move about other body structures during the falling event. That is, the knee is situated atop the tibia and fibula of the user and these bones are situated atop the ankle of the user. During a fall, the tibia and fibula typically will pivot at least somewhat about the ankle or at least with respect to the ground. The hips and pelvis are situated atop the femurs of the user and likewise pivot about the ankle and potentially the knee during a falling event.

The result is that the knees, hips, and pelvis of the user move toward the ground during a falling event at velocities that are less than that which would ordinarily result purely from the acceleration due to gravity. Since the ignition of the propellant 96 causes the corresponding cushion elements 40 to expand nearly instantaneously, the ignition of the propellant 96 is desirably timed, i.e., delayed, so that the cushion element 40 is expanded into protective proximity with the protected body part just prior to the time at which the protected body part would otherwise strike the ground. This is done in order to enable the protected body part to experience the maximum protection afforded by the expanding cushion element 40, which would occur generally at the point where the cushion element 40 reaches a state of complete expansion and just prior to the point at which the expansion of gases from the propellant 96 ceases and the cushion element 40 begins to deflate.

The control apparatus 34 thus delays the outputting of the trigger signal by a short period of time that is intended to cause the expansion of the cushion elements 40 to be at their aforementioned maximum protective capability immediately prior to the user striking, for instance, the ground. In the depicted exemplary embodiment, the trigger signal is output from the control apparatus 34 as a delayed trigger signal which is timed to cause the one or more cushion elements 40 that are in the direction of the falling event to be completely expanded at approximately 0.03 seconds after the initiation of the falling event. Such a delay may be adjusted depending upon the perceived velocity of the falling event which can be derived from the aforementioned dθ/dt signal obtained from the sensor 76, although other indicators and/or data can be employed to determine the amount of delay needed for a particular falling event. The delay in the generation of the delayed trigger signal is desirably timed such that the following action are accomplished immediately prior to the body part striking, for instance, the ground: the control circuit 56 generates the directional trigger signal, which is communicated to the corresponding igniter 94, which ignites its associated propellant 96, which expands the corresponding cushion element 40, which breaks the associated frangible region 98, and which expands into protective proximity of the protected body part. The exemplary total time is described as being approximately 0.03 seconds. Since the delayed trigger signal generated by the control circuit 56 is communicated at substantially the speed of light to the corresponding igniter 94, it can be understood that the time required for ignition of the propellant 96 and expansion of the corresponding cushion element 40 is a significant factor in determining the appropriate delay.

Figure 5:
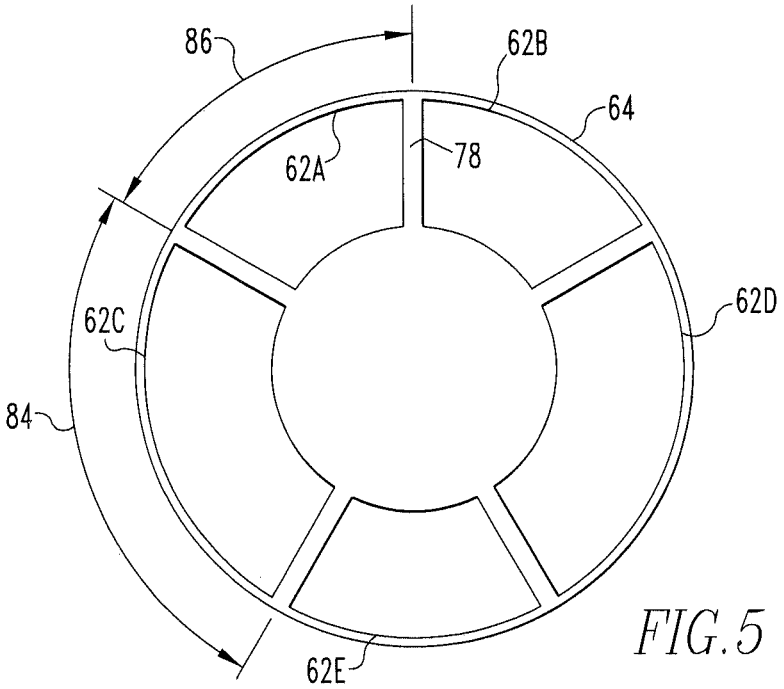
FIG. 5 is a sectional view as taken along line 5-5 of FIG. 4A.

As can be understood from FIGS. 4A and 5, the various contacts 62 are positioned about the support 64 in such a fashion that each contact 62 will be contacted by the mass 70 depending upon the direction of the falling event with respect to the user. The spaces between adjacent contacts 62 are exaggerated herein, and it is therefore understood that a given falling event may be in such a direction that the mass 70 electrically engages two of the contacts 62 that are adjacent one another, in which case the two corresponding cushion elements 40 will be expanded into protective proximity with their protected body parts. In this regard, the mass 70 may itself be somewhat flexible or may contain conductive structures that facilitate the contacting of more than one contact 62 by the mass 70 in order to provide a greater degree of protection to the user 10.

As can further be seen from FIG. 5, the contacts 62 need not each occupy an equal portion of the perimeter of the support 64. By way of example, the contacts 62C and 62D, which protect the hips of the user 10, may occupy a relatively larger portion (as indicated at the numeral 84 in FIG. 5) of the perimeter of the support 64 than the contacts 62A and 62B (as indicated at the numeral 86 in FIG. 5) and the contact 62E. This may be desirable due to, for example, the potential to break the hips from a large range of directions with respect to the user 10. Other configurations of the contacts 62 will be apparent.

It thus can be seen that the improved belt apparatus 2 is advantageously configured to appear and function during ordinary use in a fashion that is generally indistinguishable from an ordinary trouser belt, which encourages a user to regularly wear the belt apparatus 2 since no additional thought is required beyond the thought that is necessary in putting on and wearing an ordinary belt. The belt apparatus 2 is thus deployable to protect a person from injury due to bone breakage as a result of a fall.

It is noted that the belt loops 14 of the trousers 4 desirably might be configured to avoid interference with expansion of the various cushion elements 40. For example, the belt loops 14 might be positioned so that they do not overlap any of the cushion elements 40. Alternatively or additionally, the belt loops 14 may be configured with a relatively weak attachment at the point of connection with the trousers at the lower end, i.e., the end which would be adjacent the first edge 46 of the belt element 22. Still additionally or alternatively, the protection apparatus 32 and/or the expansion apparatus 38 may be configured such that the belt loops 14 simply serve as additional frangible elements that are intended to be torn or detached from the trousers 4 by the explosive power of the ignited propellant 96.

Figure 9:
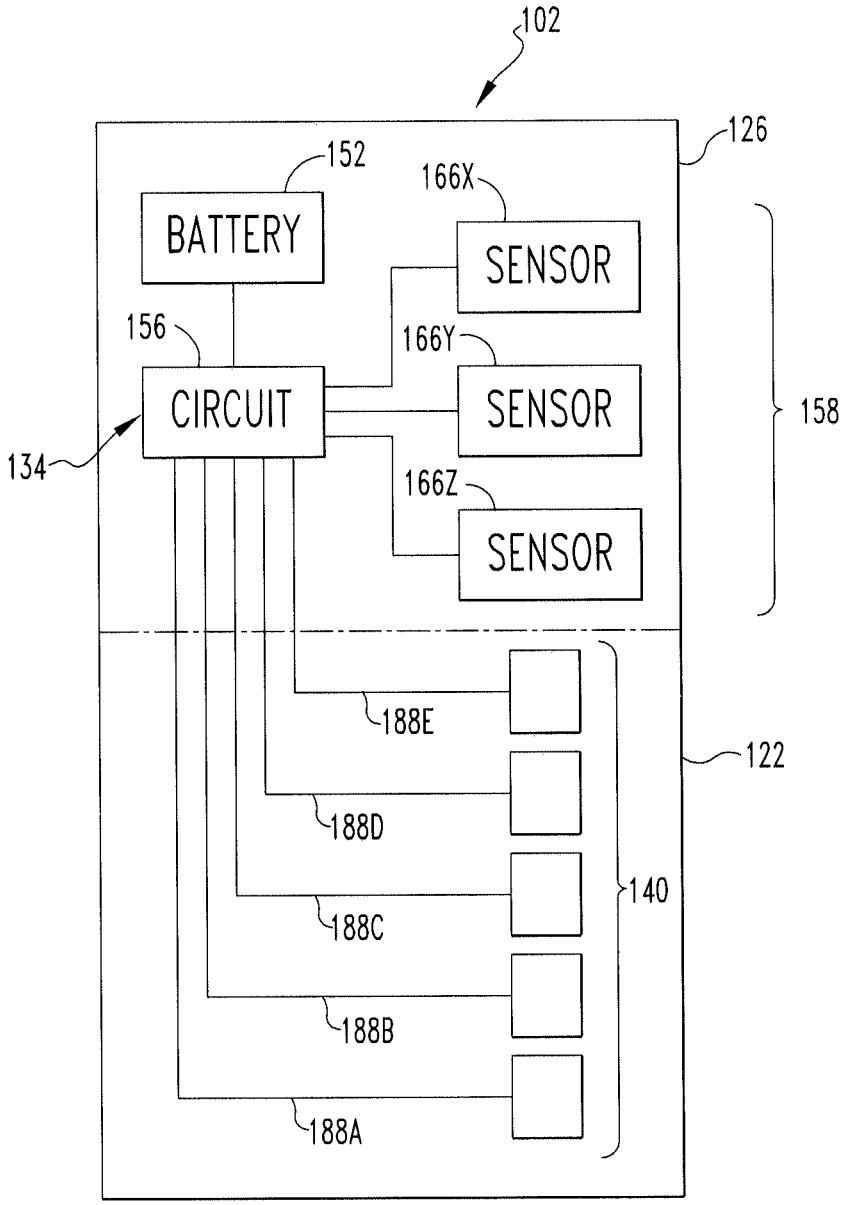
FIG. 9 is a schematic depiction of an improved belt apparatus in accordance with a second embodiment of the disclosed and claimed concept.

FIG. 9 schematically depicts an improved belt apparatus 102 in accordance with a second embodiment of the disclosed and claimed concept. The belt apparatus 102 is essentially identical to the belt apparatus 2, except that the belt apparatus 102 includes a different control apparatus 134. The control apparatus 134 is still situated on a buckle 126 of the belt apparatus 102, and a belt element 122 extends from the buckle 126. However, while the control apparatus 134 can be said to include a control circuit 156 and a number of fall detection elements 158, the exemplary number of fall detection elements 158 of the belt apparatus 102 comprise a number of sensors 166X, 166Y, and 166Z (collectively referred to herein with the numeral 166) which are each in the exemplary form of an accelerometer. That is, the sensors 166 might be accelerometers that are oriented orthogonal to one another, or they may be other types of sensors. Moreover, the sensors 166 need not necessarily be situated orthogonal to one another, and it is possible that a lesser quantity of accelerometers or other sensors can be oriented in various directions from which sufficient signals can be input to the control circuit 156 to enable the control circuit 156 to identify the onset of a falling event. The control circuit 156 likewise provides a delayed trigger signal that is timed to coincide with a moment just prior to the user striking, for example, the ground, and the trigger signal is moreover a directional trigger signal which causes expansion of one or more of a plurality of cushion elements 140A, 140B, 140C, 140D, and 140E (collectively referred to herein with the numeral 140). The cushion elements 140 are connected with the control circuit 156 via a number of directional trigger connections which, in the depicted exemplary embodiment, include a plurality of leads 188A, 188B, 188C, 188D, and 188E (collectively referred to herein with the numeral 188) that are each connected with a corresponding one of the cushion elements 140.

It is understood, however, that the connections between the control circuit 156 and the various cushion elements 140 could be provided other than through the use of the individual dedicated leads 188. For example and depending upon the capability of the power source 152, it may be possible to provide a wired or wireless network which may or may not continually communicate signals between the control circuit 156 and the cushion elements 140 to cause one or more particular cushion elements 140 to be expanded in response to a detection of a falling event. For instance, the control circuit 156 might additionally include an RF transmitter that communicates a delayed and directional trigger signal to a particular receiver associated with a particular cushion element 140 to cause the particular cushion element 140 to expand in response to a falling event. By way of further example, instead of providing individual wires or leads that extend along the belt element 122 between the control circuit 156 and the various cushion elements 140, the belt apparatus 102 may employ a single set of leads that are heavier and that continually provide signals to the bags 140 and which, in response to a falling event, can include signals which include an instruction that one or more of the cushion elements 140 are to be expanded. Thus, the belt apparatus 2 may include wired and/or wireless networks that are used to expand the cushion elements 140. Other variations will be apparent.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A belt apparatus structured to support a trousers having a number of belt loops that are situated on an exterior surface of the trousers, the belt apparatus comprising:

a trouser support apparatus comprising an elongated and flexible belt element having a number of cavities formed therein, the belt element being structured to be received in the number of belt loops of the trousers to thereby assist in supporting the trousers at the waist of a user;

a protection apparatus comprising a number of cushion elements that are each structured to be movable from a configuration situated within a cavity of the number of cavities to an expanded configuration situated at least partially outside the cavity and in protective proximity to a body part of the user;

a control apparatus comprising a number of sensors and being structured to output a trigger signal responsive to a detection of an initiation of a falling event of the user; and an expansion apparatus which, responsive to the trigger signal, is structured to expand at least a first cushion element of the number of cushion elements from the configuration to the expanded configuration.

2. The belt apparatus of claim 1 wherein the control apparatus is structured to detect as the initiation of the falling event an initiation of a falling event in a particular direction with respect to the user and is further structured to output as the trigger signal a directional trigger signal which causes the expansion apparatus to expand as the at least first cushion element one or more cushion elements that are situated generally in the particular direction with respect to the user.

3. The belt apparatus of claim 2 wherein the number of cushion elements comprise two or more of:

a cushion element which, when in the expanded configuration, is structured to protect the right knee of the user;

a cushion element which, when in the expanded configuration, is structured to protect the left knee of the user;

a cushion element which, when in the expanded configuration, is structured to protect the right hip of the user;

a cushion element which, when in the expanded configuration, is structured to protect the left hip of the user;

a cushion element which, when in the expanded configuration, is structured to protect at least a portion of the pelvis of the user; and a cushion element which, when in the expanded configuration, is structured to protect at least a portion of the spine of the user.

4. The belt apparatus of claim 2 wherein:

the number of cushion elements comprise a left knee cushion element which, when in the expanded configuration, is structured to protect the left knee of the user and a right knee cushion element which, when in the expanded configuration, is structured to protect the right knee of the user;

the left and right knee cushion elements in the expanded configuration each comprising a first elongated portion that extends from the belt element in a direction generally toward the corresponding knee and a second elongated portion that extends from the first elongated portion and at least a portion of which is offset from the first elongated portion in a direction different than the direction of elongation of the first elongated portion.

5. The belt apparatus of claim 2 wherein the control apparatus is structured to output as the directional trigger signal a signal which causes the expansion apparatus to expand as the at least first cushion element fewer than all of the cushion elements.

6. The belt apparatus of claim 1 wherein each cushion element of the number of cushion elements in the configuration is situated in substantially its entirety within a corresponding cavity of the number of cavities.

7. The belt apparatus of claim 1 wherein the control apparatus is further structured to output, as the trigger signal a delayed trigger signal that is output after a predetermined delay period which is subsequent to the detection of the initiation of the falling event but prior to the user striking the ground.

8. The belt apparatus of claim 1 wherein the number of sensors comprise a number of accelerometers, and wherein the control apparatus comprises a processor in electronic communication with the number of accelerometers and on which a number of instructions are executable, the control apparatus being structured to detect at least in part from a number of signals received from the number accelerometers the initiation of the falling event and to responsively output the trigger signal.

9. The belt apparatus of claim 1 wherein the belt element has a length, a width, and a thickness, with the length being greater than the width, and with the width being greater than the thickness.

10. The belt apparatus of claim 9 wherein the thickness substantially unvarying along substantially the entirety of the longitudinal extent of the belt element.

11. The belt apparatus of claim 10 wherein the width is substantially unvarying along substantially the entirety of the longitudinal extent of the belt element.

12. The belt apparatus of claim 9 wherein the belt element comprises a number of frangible regions situated on or adjacent at least one elongated edge of the belt element and which, upon movement of one or more of the number of cushion elements toward the expanded configuration, are structured to form openings between the exterior of the belt element and one or more of the number of cavities that correspond with the one or more of the number of cushion elements through which the number of cushion elements in the expanded configuration extend.

13. The belt apparatus of claim 12 wherein the frangible regions are each of a lesser strength than another portion of the belt element and are situated in communication with the number of cavities.

14. The belt apparatus of claim 1 wherein the belt element has cross-sectional dimensions that are substantially unvarying along substantially the entirety of the longitudinal extent of the belt element.

15. The belt apparatus of claim 1 wherein the trouser support apparatus further comprises a fastener that is cooperable with the belt element and is structured to retain the belt element at a selected circumferential length to thereby assist in the supporting of the trousers at the waist of the user when the belt element is received in the number of belt loops.

16. The belt apparatus of claim 1 wherein the configuration is a collapsed configuration.

* * * * *